US010145194B2

(12) United States Patent
Dagenais et al.

(10) Patent No.: US 10,145,194 B2
(45) Date of Patent: Dec. 4, 2018

(54) METHODS OF REMOVING A WELLBORE ISOLATION DEVICE USING A EUTECTIC COMPOSITION

(75) Inventors: Pete Dagenais, Carrollton, TX (US); Michael Fripp, Carrollton, TX (US); Syed Hamid, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 594 days.

(21) Appl. No.: 13/523,095

(22) Filed: Jun. 14, 2012

(65) Prior Publication Data

US 2013/0333890 A1 Dec. 19, 2013

(51) Int. Cl.

| | |
|---|---|
| ***E21B 29/00*** | (2006.01) |
| ***E21B 29/02*** | (2006.01) |
| ***E21B 33/12*** | (2006.01) |
| ***E21B 33/134*** | (2006.01) |

(52) U.S. Cl.

CPC ..... *E21B 29/00* (2013.01); *E21B 29/02* (2013.01); *E21B 33/1208* (2013.01); *E21B 33/134* (2013.01)

(58) Field of Classification Search

CPC ..... E21B 29/00; E21B 33/12; E21B 33/1208; E21B 33/13; E21B 33/134; E21B 43/14; E21B 43/26; E21B 43/116

USPC ..... 166/302

See application file for complete search history.

(56) References Cited

U.S. PATENT DOCUMENTS

| | | | |
|---|---|---|---|
| 2,298,129 | A | 10/1942 | Irons |
| 2,656,891 | A | 10/1953 | Toelke |
| 3,208,530 | A | 9/1965 | Allen et al. |
| 3,273,641 | A | 9/1966 | Bourne |

(Continued)

FOREIGN PATENT DOCUMENTS

| | | | |
|---|---|---|---|
| GB | 2480869 | A | 12/2011 |
| WO | 20110151271 | A1 | 12/2011 |
| WO | 2014100141 | A2 | 6/2014 |

OTHER PUBLICATIONS

Degradable Casing Perforation Ball Sealers and Methods for Use in Well Treatment, IPCOM000215741D, Mar. 7, 2012. Available at: http://priorartdatabase.com/IPCOM/000215741.

(Continued)

*Primary Examiner* — Zakiya W Bates
*Assistant Examiner* — Crystal J Miller
(74) *Attorney, Agent, or Firm* — McGuireWoods LLP

(57) ABSTRACT

A wellbore isolation device comprises: a first composition, wherein the first composition comprises: (A) a first substance; and (B) a second substance, wherein the first composition has a solid-liquid phase transformation temperature less than the solid-liquid phase transformation temperatures of at least the first substance or the second substance at a specific pressure. A method of removing a wellbore isolation device comprises: increasing the temperature surrounding the wellbore isolation device; and allowing at least a portion of the first composition to undergo a phase transformation from a solid to a liquid. A method of inhibiting or preventing fluid flow in a wellbore comprises: decreasing the temperature of at least a portion of the wellbore; positioning the wellbore isolation device in the at least a portion of the wellbore; and increasing the temperature of the at least a portion of the wellbore.

23 Claims, 2 Drawing Sheets

(56) References Cited

U.S. PATENT DOCUMENTS

| | | | | |
|---|---|---|---|---|
| 3,578,084 | A | 5/1971 | Bombardieri et al. | |
| 4,716,964 | A | 1/1988 | Erbstoesser et al. | |
| 4,939,038 | A | 7/1990 | Inabata | |
| 5,419,357 | A | 5/1995 | Lhymn et al. | |
| 5,561,829 | A | 10/1996 | Sawtell et al. | |
| 6,237,688 | B1 * | 5/2001 | Burleson | E21B 29/02 166/281 |
| 6,349,766 | B1 * | 2/2002 | Bussear | E21B 33/127 166/113 |
| 7,350,582 | B2 | 4/2008 | McKeachnie et al. | |
| 7,353,879 | B2 | 4/2008 | Todd et al. | |
| 7,798,236 | B2 | 9/2010 | McKeachnie et al. | |
| 8,535,604 | B1 | 9/2013 | Baker et al. | |
| 2002/0056553 | A1 | 5/2002 | Duhon et al. | |
| 2006/0037748 | A1 * | 2/2006 | Wardlaw | E21B 36/008 166/277 |
| 2006/0144591 | A1 * | 7/2006 | Gonzalez | E21B 29/10 166/277 |
| 2006/0175703 | A1 | 8/2006 | Godijn et al. | |
| 2007/0107908 | A1 * | 5/2007 | Vaidya | E21B 34/14 166/376 |
| 2007/0199693 | A1 | 8/2007 | Kunz | |
| 2008/0093073 | A1 | 4/2008 | Bustos et al. | |
| 2008/0149345 | A1 * | 6/2008 | Marya | E21B 23/00 166/376 |
| 2008/0202764 | A1 * | 8/2008 | Clayton | E21B 29/02 166/376 |
| 2009/0226340 | A1 | 9/2009 | Marya | |
| 2010/0032151 | A1 | 2/2010 | Duphorne | |
| 2010/0078173 | A1 | 4/2010 | Buytaert | |
| 2010/0101803 | A1 * | 4/2010 | Clayton | E21B 29/02 166/376 |
| 2010/0236785 | A1 | 9/2010 | Collis et al. | |
| 2010/0243269 | A1 * | 9/2010 | Solhaug | E21B 41/00 166/374 |
| 2011/0011591 | A1 | 1/2011 | Watters et al. | |
| 2011/0094755 | A1 | 4/2011 | Corbett et al. | |
| 2011/0213101 | A1 | 9/2011 | Shi | |
| 2011/0278011 | A1 * | 11/2011 | Crainich, Jr. | C04B 40/0092 166/310 |
| 2012/0031626 | A1 * | 2/2012 | Clayton | E21B 29/02 166/376 |
| 2012/0118583 | A1 * | 5/2012 | Johnson | E21B 29/02 166/376 |
| 2012/0175109 | A1 * | 7/2012 | Richard | E21B 43/11 166/250.12 |
| 2012/0181032 | A1 * | 7/2012 | Naedler | E21B 43/26 166/308.1 |
| 2012/0211239 | A1 | 8/2012 | Kritzler et al. | |
| 2013/0059074 | A1 | 3/2013 | Xu et al. | |
| 2013/0081801 | A1 | 4/2013 | Liang et al. | |
| 2013/0087335 | A1 * | 4/2013 | Carragher | E21B 23/00 166/288 |
| 2013/0098203 | A1 | 4/2013 | Sherman et al. | |
| 2013/0327540 | A1 * | 12/2013 | Hamid | E21B 33/1208 166/376 |
| 2013/0333890 | A1 | 12/2013 | Dagenais et al. | |
| 2014/0027128 | A1 * | 1/2014 | Johnson | B22F 1/02 166/376 |
| 2014/0060837 | A1 * | 3/2014 | Love | E21B 43/26 166/297 |

OTHER PUBLICATIONS

Solu-Plugs—Delayed Frac Plugs, IPCOM000176055D, Nov. 3, 2008. Available at: http://www.ip.com/pubview/IPCOM000176055D.

European Patent Office, Communication of Supplementary European Search Report, Appn. No. EP13804991, Jul. 26, 2016.

European Patent Office, Communication, Application No. 14832879.2, dated Feb. 23, 2017.

European Patent Office, Extended European Search Report, Appln. 14870921.5, dated Mar. 30, 2017.

Canadian Intellectual Property Office, Examiner Requisition, Appln. 2,925,108, Mar. 27, 2017.

* cited by examiner

METHODS OF REMOVING A WELLBORE ISOLATION DEVICE USING A EUTECTIC COMPOSITION

TECHNICAL FIELD

An isolation device and methods of using and removing the isolation device are provided. The isolation device includes at least a first composition. The first composition can be a eutectic composition or a hyper- or hypo-eutectic composition. According to an embodiment, the isolation device is used in an oil or gas operation.

SUMMARY

According to an embodiment, a wellbore isolation device comprises: a first composition, wherein the first composition comprises: (A) a first substance; and (B) a second substance, wherein the first composition has a solid-liquid phase transformation temperature less than the solid-liquid phase transformation temperatures of at least the first substance or the second substance at a specific pressure.

According to another embodiment, a method of removing the wellbore isolation device comprises: increasing the temperature surrounding the wellbore isolation device; and allowing at least a portion of the first composition to undergo a phase transformation from a solid to a liquid.

According to another embodiment, a method of inhibiting or preventing fluid flow in a wellbore comprises: decreasing the temperature of at least a portion of the wellbore; positioning the wellbore isolation device in the at least a portion of the wellbore; and increasing the temperature of the at least a portion of the wellbore, wherein the step of increasing is performed after the step of positioning the wellbore isolation device, and wherein at least a portion of the first composition undergoes a phase transformation from a solid to a liquid during or after the step of increasing the temperature.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
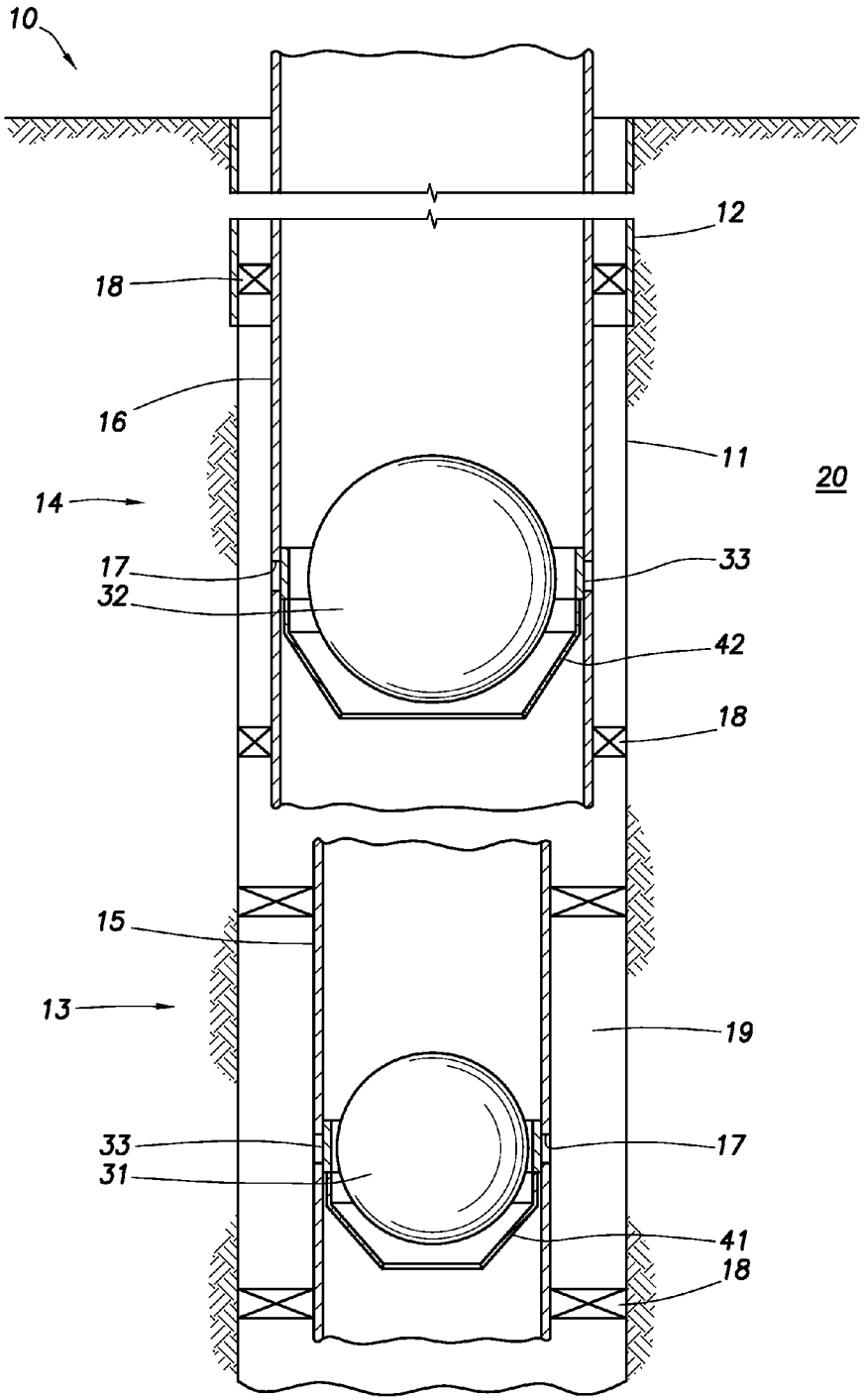
FIG. 1 depicts a well system containing more than one isolation device.

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more compositions, substances, etc., as the case may be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and to conform to the outline of its container when the substance is tested at a temperature of 71° F. (21.7° C.) and a pressure of one atmosphere "atm" (0.1 megapascals "MPa"). A fluid can be a liquid or gas.

Oil and gas hydrocarbons are naturally occurring in some subterranean formations. A subterranean formation containing oil or gas is sometimes referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir.

A "well" can include, without limitation, an oil, gas, or water production well, an injection well, or a geothermal well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. It is often desirable to treat one or more locations within multiples zones of a formation. One or more zones of the formation can be isolated within the wellbore via the use of an isolation device. An isolation device can be used for zonal isolation and functions to block fluid flow within a tubular, such as a tubing string, or within an annulus. The blockage of fluid flow prevents the fluid from flowing into the zones located downstream of the isolation device and isolates the zone of interest. As used herein, the relative term "downstream" means at a location further away from a wellhead. In this manner, treatment techniques can be performed within the zone of interest.

Common isolation devices include, but are not limited to, a ball, a plug, a bridge plug, a wiper plug, and a packer. It is to be understood that reference to a "ball" is not meant to limit the geometric shape of the ball to spherical, but rather is meant to include any device that is capable of engaging with a seat. A "ball" can be spherical in shape, but can also be a dart, a bar, or any other shape. Zonal isolation can be accomplished, for example, via a ball and seat by dropping the ball from the wellhead onto the seat that is located within the wellbore. The ball engages with the seat, and the seal created by this engagement prevents fluid communication into other zones downstream of the ball and seat. In order to treat more than one zone using a ball and seat, the wellbore can contain more than one ball seat. For example, a seat can be located within each zone. Generally, the inner diameter (I.D.) of the tubing string where the ball seats are located is different for each zone. For example, the I.D. of the tubing string sequentially decreases at each zone, moving from the wellhead to the bottom of the well. In this manner, a smaller ball is first dropped into a first zone that is the farthest downstream; that zone is treated; a slightly larger ball is then dropped into another zone that is located upstream of the first zone; that zone is then treated; and the process continues in this fashion—moving upstream along the wellbore—until all the desired zones have been treated. As used herein, the relative term "upstream" means at a location closer to the wellhead.

A bridge plug is composed primarily of slips, a plug mandrel, and a rubber sealing element. A bridge plug can be introduced into a wellbore and the sealing element can be caused to block fluid flow into downstream zones. A packer generally consists of a sealing device, a holding or setting device, and an inside passage for fluids. A packer can be used to block fluid flow through the annulus located between the outside of a tubular and the wall of the wellbore or inside of a casing.

Isolation devices can be classified as permanent or retrievable. While permanent isolation devices are generally designed to remain in the wellbore after use, retrievable devices are capable of being removed after use. It is often desirable to use a retrievable isolation device in order to restore fluid communication between one or more zones. Traditionally, isolation devices are retrieved by inserting a retrieval tool into the wellbore, wherein the retrieval tool engages with the isolation device, attaches to the isolation device, and the isolation device is then removed from the wellbore. Another way to remove an isolation device from the wellbore is to mill at least a portion of the device. Yet, another way to remove an isolation device is to contact the device with a solvent, such as an acid, thus dissolving all or a portion of the device.

However, some of the disadvantages to using traditional methods to remove a retrievable isolation device include: it can be difficult and time consuming to use a retrieval tool; milling can be time consuming and costly; and premature dissolution of the isolation device can occur. For example, premature dissolution can occur if acidic fluids are used in the well prior to the time at which it is desired to dissolve the isolation device.

The bottomhole temperature of a well varies significantly, depending on the subterranean formation, and can range from about 100° F. to about 600° F. (about 37.8° C. to about 315.6° C.). As used herein, the term "bottomhole" means at the location of the isolation device. It is often desirable to have a substance melt at the bottomhole temperature of a well. However, the options of elements available for use in these circumstances are severely limited because there are only so many elements to choose from and each element has a single, unique melting point at a given pressure. Therefore, a more expensive element may have to be used that has a melting point equal to the bottomhole temperature of the well. A composition of two or more substances will have a melting point that is different from the melting points of the individual substances making up the mixture. The use of compositions increases the number of melting points available to choose from. In this manner, one can determine the bottomhole temperature and pressure of a well and then select the appropriate composition for use at that temperature and pressure.

A novel method of removing an isolation device includes causing or allowing an increase in the temperature surrounding the isolation device. The isolation device includes at least a first composition comprising a first and second substance. The first composition has a solid-liquid phase transformation temperature less than the solid-liquid phase transformation temperatures of at least the first or second substances. The first composition can be a eutectic, hypoeutectic, or hypereutectic composition. The exact temperature at which the composition undergoes a phase transformation from a solid to a liquid can be predetermined, and the first and second substances, and ratios thereof, can be adjusted to yield the predetermined phase transformation temperature.

A eutectic composition is a mixture of two or more substances that undergoes a solid-liquid phase transformation at a lower temperature than any other composition made up of the same substances. Stated another way, the temperature at which a eutectic composition undergoes the solid-liquid phase transformation is a lower temperature than any composition made up of the same substances can freeze or melt at and is referred to as the eutectic temperature. A solid-liquid phase transformation temperature can also be referred to as the freezing point or melting point of a substance or composition. The substances making up the eutectic composition can be compounds, such as metal alloys or thermoplastics, or metallic elements. The eutectic composition undergoes the solid-liquid phase transformation at a temperature that is lower than the solid-liquid phase transformations of at least one of the individual substances making up the composition. The solid-liquid phase transformation temperature can be greater than one or more of the individual substances making up the composition, but should be less than at least one of the substances. By way of example, the melting point of bismuth at atmospheric pressure (101 kilopascals) is 520° F. (271.1° C.) and the melting point of lead is 621° F. (327.2° C.); however, the melting point of a composition containing 55.5% bismuth and 44.5% lead has a melting point of 244° F. (117.8° C.). As can be seen the bismuth-lead composition has a much lower melting point than both, elemental bismuth and elemental lead. Not all compositions have a melting point that is lower than all of the individual substances making up the composition. By way of example, a composition of silver and gold has a higher melting point compared to pure silver and pure gold. Therefore, a silver-gold composition cannot be classified as a eutectic composition.

A eutectic composition can also be differentiated from other compositions because it solidifies (or melts) at a single, sharp temperature. It is to be understood that the phrase "solid-liquid phase transformation," the term "melt" and all grammatical variations thereof, and the term "freeze" and all grammatical variations thereof are meant to be synonymous. Non-eutectic compositions generally have a range of temperatures at which the composition melts. There are other compositions that can have both: a range of temperatures at which the composition melts; and a melting point less than at least one of the individual substances making up the composition. These other substances can be called hypo- and hyper-eutectic compositions. A hypo-eutectic composition contains the minor substance (i.e., the substance that is in the lesser concentration) in a smaller amount than in the eutectic composition of the same substances. A hyper-eutectic composition contains the minor substance in a larger amount than in the eutectic composition of the same substances.

Generally, with few exceptions, a hypo- and hyper-eutectic composition will have a solid-liquid phase transition temperature higher than the eutectic temperature but less than the melting point of at least one of the individual substances making up the composition.

The following table illustrates a eutectic, hypo- and hyper-eutectic composition, the concentration of each substance making up the composition (expressed as a % by weight of the composition), and their corresponding eutectic temperature and melting temperature ranges. As can be seen, the hyper-eutectic composition contains cadmium (the minor substance) in a larger amount than the eutectic composition, and the hypo-eutectic composition contains cadmium in a smaller amount than in the eutectic composition. As can also be seen, both the hyper- and hypo-eutectic compositions have a range of melting points; whereas, the eutectic composition has a single melting temperature. Moreover, all 3 compositions have a eutectic temperature or melting point range that is lower than each of the 4 individual elements—Bi equals 520° F. (271.1° C.), Pb equals 621° F. (327.2° C.), Sn equals 450° F. (232.2° C.), and Cd equals 610° F. (321.1° C.).

| Type of Composition | Conc. of Bismuth (Bi) | Conc. of Lead (Pb) | Conc. of Tin (Sn) | Conc. of Cadmium (Cd) | Melting Temperature (° F.) |
|---|---|---|---|---|---|
| Eutectic | 50 | 26.7 | 13.3 | 10 | 158 |
| Hyper-eutectic | 50 | 25 | 12.5 | 12.5 | 158-165 |
| Hypo-eutectic | 50.5 | 27.8 | 12.4 | 9.3 | 158-163 |

According to an embodiment, a wellbore isolation device comprises: a first composition, wherein the first composition comprises: (A) a first substance; and (B) a second substance, wherein the first composition has a solid-liquid phase transformation temperature less than the solid-liquid phase transformation temperatures of at least the first substance or the second substance at a specific pressure.

According to another embodiment, a method of removing the wellbore isolation device comprises: increasing the temperature surrounding the wellbore isolation device; and allowing at least a portion of the first composition to undergo a phase transformation from a solid to a liquid.

According to another embodiment, a method of inhibiting or preventing fluid flow in a wellbore comprises: decreasing the temperature of at least a portion of the wellbore; positioning the wellbore isolation device in the at least a portion of the wellbore; and increasing the temperature of the at least a portion of the wellbore, wherein the step of increasing is performed after the step of positioning the wellbore isolation device, and wherein at least a portion of the first composition undergoes a phase transformation from a solid to a liquid during or after the step of increasing the temperature.

Any discussion of the embodiments regarding the isolation device or any component related to the isolation device (e.g., the first composition) is intended to apply to all of the apparatus and method embodiments.

Turning to the Figures, FIG. 1 depicts a well system 10. The well system 10 can include at least one wellbore 11. The wellbore 11 can penetrate a subterranean formation 20. The subterranean formation 20 can be a portion of a reservoir or adjacent to a reservoir. The wellbore 11 can include a casing 12. The wellbore 11 can include only a generally vertical wellbore section or can include only a generally horizontal wellbore section. A first section of tubing string 15 can be installed in the wellbore 11. A second section of tubing string 16 (as well as multiple other sections of tubing string, not shown) can be installed in the wellbore 11. The well system 10 can comprise at least a first zone 13 and a second zone 14. The well system 10 can also include more than two zones, for example, the well system 10 can further include a third zone, a fourth zone, and so on. The well system 10 can further include one or more packers 18. The packers 18 can be used in addition to the isolation device to isolate each zone of the wellbore 11. The isolation device can be the packers 18. The packers 18 can be used to help prevent fluid flow between one or more zones (e.g., between the first zone 13 and the second zone 14) via an annulus 19. The tubing string 15/16 can also include one or more ports 17. One or more ports 17 can be located in each section of the tubing string. Moreover, not every section of the tubing string needs to include one or more ports 17. For example, the first section of tubing string 15 can include one or more ports 17, while the second section of tubing string 16 does not contain a port. In this manner, fluid flow into the annulus 19 for a particular section can be selected based on the specific oil or gas operation.

It should be noted that the well system 10 is illustrated in the drawings and is described herein as merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing. For example, the well system 10 can further include a well screen. By way of another example, cement may be used instead of packers 18 to aid the isolation device in providing zonal isolation. Cement may also be used in addition to packers 18.

As can be seen in FIG. 1, the first section of tubing string 15 can be located within the first zone 13 and the second section of tubing string 16 can be located within the second zone 14. As depicted in the drawings, the isolation device can be a ball 30 (e.g., a first ball 31 or a second ball 32) and a seat 40 (e.g., a first seat 41 or a second seat 42). The ball 30 can engage the seat 40. The seat 40 can be located on the inside of a tubing string. When the first section of tubing string 15 is located downstream of the second section of tubing string 16, then the inner diameter (I.D.) of the first section of tubing string 15 can be less than the I.D. of the second section of tubing string 16. In this manner, a first ball 31 can be placed into the first section of tubing string 15. The first ball 31 can have a smaller diameter than a second ball 32. The first ball 31 can engage a first seat 41. Fluid can now be temporarily restricted or prevented from flowing into any zones located downstream of the first zone 13. In the event it is desirable to temporarily restrict or prevent fluid flow into any zones located downstream of the second zone 14, the second ball 32 can be placed into second section of tubing string 16 and will be prevented from falling into the first section of tubing string 15 via the second seat 42 or because the second ball 32 has a larger outer diameter (O.D.) than the I.D. of the first section of tubing string 15. The second ball 32 can engage the second seat 42. The ball (whether it be a first ball 31 or a second ball 32) can engage a sliding sleeve 33 during placement. This engagement with the sliding sleeve 33 can cause the sliding sleeve to move; thus, opening a port 17 located adjacent to the seat. The port 17 can also be opened via a variety of other mechanisms instead of a ball. The use of other mechanisms may be advantageous when the isolation device is not a ball. After placement of the isolation device, fluid can be flowed from, or into, the subterranean formation 20 via one or more opened ports 17 located within a particular zone. As such, a fluid can be produced from the subterranean formation 20 or injected into the formation.

According to an embodiment, the isolation device is at least partially capable of restricting or preventing fluid flow between a first zone 13 and a second zone 14. By way of example, the isolation device can be used to restrict or prevent fluid flow between different zones within the tubing string while packers 18 and/or cement can be used to restrict or prevent fluid flow between different zones within the annulus 19. The isolation device can also be the only device used to prevent or restrict fluid flow between zones. By way of another example, there can also be two or more isolation devices positioned within a given zone. According to this example, one isolation device can be a packer while the other isolation device can be a ball and seat or a bridge plug. The first zone 13 can be located upstream or downstream of the second zone 14. In this manner, depending on the oil or gas operation, fluid is restricted or prevented from flowing downstream or upstream into the second zone 14. Examples of isolation devices capable of restricting or preventing fluid flow between zones include, but are not limited to, a ball, a plug, a bridge plug, a wiper plug, and a packer.

The isolation device comprises a first composition 51. The first composition 51 comprises a first substance and a second substance at a specific pressure. The first composition 51 can also comprise more than two substances (e.g., a third, a fourth, and so on substance). The first and second substance, and any other substances, can be an element or a compound. The first and second substance, and any other substances, can be selected from the group consisting of a metal, a metal alloy, and a plastic. According to an embodiment, the plastic is a thermoplastic. The metal or metal alloy can be selected from the group consisting of, lithium, sodium, potassium, rubidium, cesium, francium, beryllium, magnesium, calcium, strontium, barium, radium, aluminum, gallium, indium, tin, thallium, lead, bismuth, scandium, titanium, vanadium, chromium, manganese, iron, cobalt, nickel, copper, zinc, yttrium, zirconium, niobium, molybdenum, technetium, ruthenium, rhodium, palladium, silver, cadmium, lanthanum, hafnium, tantalum, tungsten, rhenium, osmium, iridium, platinum, gold, graphite, and combinations thereof. Preferably, the metal or metal alloy is selected from the group consisting of beryllium, tin, iron, nickel, copper, zinc, and combinations thereof. According to an embodiment, the metal is not, and the metal alloy does not comprise, a toxic heavy metal. According to an embodiment, the first and second substances are different. By way of example, the first substance can be a metal and the second substance can be a different metal. Moreover, the first substance can be a metal and the second substance can be a metal alloy or a plastic.

Preferably, the first and second substances, and any other substances, are intermixed to form the first composition 51. As used herein, the term "intermixed" means that all of the substances are relatively uniformly distributed throughout the composition and very few pockets, if any, of a substance exist.

According to an embodiment, the first composition 51 (and any other compositions—e.g., the second composition 52) is a solid at a temperature of 71° F. (21.7° C.) and a pressure of 101 kilopascals (kPa). The first composition 51 has a solid-liquid phase transformation temperature less than the solid-liquid phase transformation temperatures of at least the first substance or the second substance at a specific pressure. The first composition 51 can also have a solid-liquid phase transformation temperature less than the solid-liquid phase transformation temperatures of both the first substance and the second substance. If the first composition 51 comprises more than two substances, then the first composition 51 has a solid-liquid phase transformation temperature less than the solid-liquid phase transformation temperature of at least one, or all, of the individual substances making up the first composition 51. According to an embodiment, the first composition 51 is a eutectic composition. Accordingly, the solid-liquid phase transformation temperature can be the eutectic temperature. According to another embodiment, the first composition 51 is a hypo-eutectic composition. According to yet another embodiment, the first composition 51 is a hyper-eutectic composition. The solid-liquid phase transformation temperature of the first composition 51 can be a single temperature or it can be a range of temperatures. As stated above, a eutectic composition will have a single solid-liquid phase transformation temperature; while a hypo- and hyper-eutectic composition will generally have a range of solid-liquid phase transformation temperatures.

Figure 3:
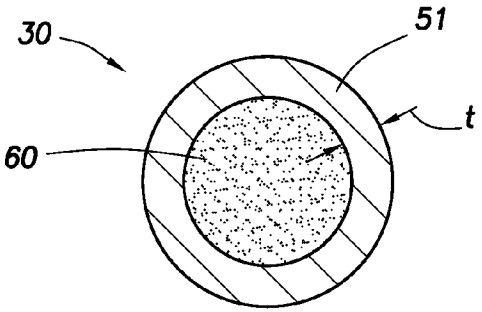
Figure 2:
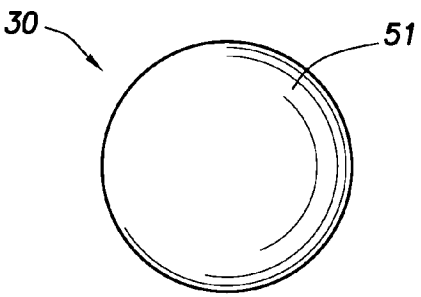

FIGS. 1-4, depict the isolation device as a ball 30 and a seat 40. It is to be understood that even though the drawings depict a ball and seat isolation device, the isolation device can also be any other device, such as a bridge plug or packer, that is capable of providing zonal isolation. It is also to be understood that any discussion regarding the ball and seat is meant to apply to any isolation device in addition to a ball and a seat. FIG. 2 depicts the ball 30 consisting of the first composition 51. FIG. 3 depicts the isolation device according to another embodiment. The isolation device illustrated in FIG. 3 can include an outer layer of the first composition 51. The thickness t of the outer layer can be adjusted to control the rate of phase transformation from a solid to a liquid of the first composition 51. As used herein, the phrase "phase transformation from a solid to a liquid" means at least a portion of the composition becomes a liquid and is synonymous with the term "melt" and all grammatical variations thereof. It is to be understood that not all of the composition needs to melt or become a complete liquid. Part of the composition can become a semi-liquid or become a liquid. Moreover, there can be combinations of various states, for example: some solid and some semi-liquid; some solid and some liquid; or some solid, some liquid, and some semi-liquid. According to the embodiment depicted in FIG. 3, the ball 30 can further comprise a particulate 60. The particulate 60 can be selected from the group consisting of sand, plastic granules, ceramic beads, fibers, whiskers, woven materials, glass microspheres, hollow glass microspheres, and combinations thereof. According to an embodiment, the particulate 60 is incapable of melting at the bottomhole temperature of the well. Preferably, the particulate 60 has a size distribution less than or equal to a sufficient size such that the particulate is capable of being flowed from the wellbore 11 after the first composition 51 has melted. Although not shown, the isolation device can include a hollow cavity instead of a particulate.

Figure 4:
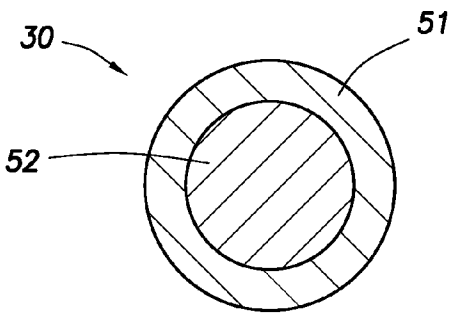
FIGS. 2-4 depict an isolation device according to different embodiments.

FIG. 4 depicts the isolation device according to another embodiment. The isolation device can further comprise a second composition 52. The isolation device can also include more than two compositions (e.g., a third composition, a fourth composition, and so on). Any discussion regarding the second composition 52 is meant to apply to any additional compositions without the need to restate all the particular embodiments for each composition. The second composition 52 comprises a third substance and a fourth substance. The second composition 52 can also comprise more than two substances. The substances can be an element or a compound. The substances can be selected from the group consisting of a metal, a metal alloy, and a plastic. According to an embodiment, the plastic is a thermoplastic or a wax. According to an embodiment, at least one of the substances making up the second composition 52 is different from each of the substances making up the first composition 51. If the isolation device includes more than two compositions, then preferably, at least one substance in each composition is different from any of the substances making up the other compositions. By way of example, the first composition can comprise a first substance of tin and a second substance of lead; the second composition can comprise substances of bismuth and lead; and a third composition can comprise substances of cadmium and bismuth. The second composition 52 has a solid-liquid phase transformation temperature less than the solid-liquid phase transformation temperatures of at least one of the individual substance making up the second composition 52. The second composition 52 can be a eutectic composition, hypo-eutectic composition, or a hyper-eutectic composition. The isolation device can also comprise multiple layers of different compositions, each composition having a different transition temperature than the other compositions.

According to an embodiment, at least the first composition 51 is capable of withstanding a specific pressure differential (for example, the isolation device depicted in FIG. 2). As used herein, the term "withstanding" means that the substance does not crack, break, or collapse. The pressure differential can be the bottomhole pressure of the subterranean formation 20 across the device. Formation pressures can range from about 1,000 to about 30,000 pounds force per square inch (psi) (about 6.9 to about 206.8 megapascals "MPa"). The pressure differential can also be created during oil or gas operations. For example, a fluid, when introduced into the wellbore 11 upstream or downstream of the isolation device, can create a higher pressure above or below, respectively, of the isolation device. Pressure differentials can range from about 100 to over 10,000 psi (about 0.7 to over 68.9 MPa). According to another embodiment, both, the first composition 51 and the particulate 60 are capable of withstanding a specific pressure differential (for example, the isolation device depicted in FIG. 3). According to yet another embodiment, both, the first composition 51 and the second composition 52 are capable of withstanding a specific pressure differential (for example, the isolation device depicted in FIG. 4).

According to an embodiment, the solid-liquid phase transformation temperature of the second composition 52 is different from the solid-liquid phase transformation temperature of the first composition 51. The second composition 52 transformation temperature can be higher or lower than the first composition 51 transformation temperature. Whether the transformation temperature of the second composition 52 is higher or lower can depend on the specific oil or gas operation to be performed and the desired amount of time for the isolation device to be removed from the wellbore 11. If the isolation device includes more than two compositions, then preferably, the transition temperature of each composition is different from the other compositions.

The methods include the step of decreasing the temperature of at least a portion of the wellbore. The step of decreasing can include introducing a fluid into the portion of the wellbore. The fluid can be a variety of types of fluids used in oil or gas operations, for example, drilling fluids, injection fluids, fracturing fluids, work-over fluids, acidizing fluids, gravel packing fluids, completion fluids, and stimulation fluids. According to this embodiment, the fluid being introduced into the wellbore 11 has a surface temperature that is less than the solid-liquid phase transformation temperature of the first composition 51. By way of example, fracturing fluids can cool the bottomhole temperature of the portion of the wellbore by over 100° F. (37.8° C.).

The methods include the step of positioning the wellbore isolation device in the at least a portion of the wellbore. The step of positioning can be performed after the step of decreasing the temperature of at least a portion of the wellbore. According to another embodiment, the methods can further include the step of positioning the isolation device in a portion of the wellbore 11, wherein the step of positioning is performed prior to the step of increasing the temperature surrounding the wellbore isolation device. The step of positioning can include installing the wellbore isolation device in the portion of the wellbore. More than one isolation device can also be positioned in multiple portions of the wellbore. According to an embodiment, the isolation device is positioned such that it is capable of restricting or preventing fluid flow within a portion of the wellbore. The isolation device can also be positioned such that a first zone is isolated from a second zone.

The methods include the step of increasing the temperature surrounding the wellbore isolation device. As used herein, the phrase "surrounding the wellbore isolation device" means the area immediately adjacent to at least a portion of the isolation device. By way of example, the isolation device can be surrounded on the top, bottom, and sides of the device. At least one area surrounding the isolation device can have an increase in temperature at one time and another area surrounding the isolation device can have an increase in temperature at another time. For example, the area immediately adjacent to the top portion of the isolation device can have an increase in temperature and then the area immediately adjacent to the bottom portion of the device can later have an increase in temperature. The step of increasing can include introducing a fluid into the bottomhole portion of the wellbore 11. The fluid can be a liquid or a gas. The fluid can be a heated fluid. According to an embodiment, prior to and during introduction, the fluid has a temperature greater than or equal to the solid-liquid phase transformation temperature of at least the first composition 51, preferably the first composition 51 and the second composition 52 (and any other compositions).

The step of increasing the temperature surrounding the isolation device can also include a cessation of introducing a fluid into the bottomhole portion of the wellbore 11. After the fluid is no longer being introduced into the portion of the wellbore 11, the fluid no longer cools the area surrounding the isolation device, and the subterranean formation 20 can increase the bottomhole temperature and the bottomhole temperature will gradually revert to the formation temperature. According to these embodiments, the subterranean formation 20 is capable of increasing the bottomhole temperature to a temperature greater than or equal to the solid-liquid phase transformation temperature of at least the first composition 51.

At least a portion of the first composition 51 undergoes a phase transformation from a solid to a liquid. The methods can include the step of allowing at least a portion of the first composition 51 to undergo a phase transformation from a solid to a liquid. At least a portion of the first composition 51 can melt in a desired amount of time. The desired amount of time can be pre-determined, based in part, on the specific oil or gas operation to be performed. The desired amount of time can be in the range from about 1 hour to about 2 months. The first composition 51 can be selected such that it melts at a desired temperature or range of temperatures. Different factors can be controlled that can affect the melting temperature of the first composition 51. For example, the substances chosen that make up the substance can be selected to yield the desired melting temperature(s). By way of another example, the ratios of the substances making up the composition can vary and can be selected to yield the desired melting temperature(s). The substances and their ratios can be predetermined to yield the desired melting temperature(s). The desired melting temperature can be determined based on information from a specific subterranean formation. For example, if the formation has a bottomhole temperature of 400° F. (204.4° C.), then the substances and ratios thereof can be selected to yield a composition with a melting temperature of less than 400° F. (204.4° C.) (e.g., 370° F. (187.8° C.) to 390° F. (198.9° C.). In this manner, during operations, a fluid can generally maintain the bottomhole temperature less than the melting point. Then, at the desired time, the fluid can be stopped, the fluid no longer cools the area surrounding the device, the formation will increase the bottomhole temperature to approximately 400° F. (204.4° C.), and the composition will at least partially melt. Of course, a fluid heated to greater than or equal to the melting point of the composition can also be introduced into the area surrounding the isolation device at the desired time to cause the composition to melt. Moreover, more than one fluid can be introduced into the surrounding area. Multiple fluids, each having a different temperature may be useful when more than one composition is used for a given device (as depicted in FIG. 4). In this manner, a first fluid can be introduced to cause melting of a first composition. Then a second fluid having a higher temperature than the first fluid can be introduced to cause melting of a second composition having a higher melting point than the first composition and the first fluid.

Tracers can be used to help determine whether a composition has melted. The tracers can be, without limitation, radioactive, chemical, electronic, or acoustic. For example, if it is desired that the first composition 51 melts to a point to enable the isolation device to be flowed from the wellbore 11 within 5 days and information from a tracer indicates that the isolation device has not moved from its original location, then a fluid having a higher temperature than previous fluids and the formation can be introduced into the wellbore to contact the first composition 51. By contrast, if the rate of melting is occurring too quickly, then the temperature of the fluid can be decreased to retard the melting of the composition. A tracer can be useful in determining real-time information on whether a composition has melted. By being able to monitor the presence of the tracer, workers at the surface can make on-the-fly decisions that can affect the melting rate of the composition.

It may be desirable to selectively melt certain portions of the first composition 51 at different times. By way of example, it may be desirable to melt the top portion of the isolation device first and then melt the bottom portion at a later time. This can be accomplished, for example, by introducing a first fluid into the wellbore to come in contact with the top portion of the first composition 51. There are many operations, such as stimulation operations involving fracturing or acidizing techniques, or tertiary recovery operations involving injection techniques, in which this may be desirable. After the desired operation has been performed, the bottom portion of the isolation device can be contacted by produced formation fluids or heat from the formation. The formation fluids and the formation can have a temperature sufficient to allow the remaining portion of the first composition 51 to melt.

The methods can further include the step of removing all or a portion of the melted first composition 51 and/or all or a portion of the second composition 52 or the particulate 60, wherein the step of removing is performed after the step of allowing the at least a portion of the first composition to melt or after the step of increasing the temperature of the at least a portion of the wellbore. The step of removing can include flowing the melted first composition 51 and/or the second composition 52 or particulate 60 from the wellbore 11. According to an embodiment, a sufficient amount of the first composition 51 melts such that the isolation device is capable of being flowed from the wellbore 11. According to this embodiment, the isolation device should be capable of being flowed from the wellbore via melting of the first composition 51, without the use of a milling apparatus, retrieval apparatus, or other such apparatus commonly used to remove isolation devices. The methods can include wherein at least a portion of the second composition 52 undergoes a phase transformation from a solid to a liquid, wherein the second composition melts during or after the step of increasing the at least a portion of the wellbore. According to another embodiment, the methods further include the step of allowing at least a portion of the second composition 52 to undergo a phase transformation from a solid to a liquid, wherein the step of allowing the second composition to melt is performed after the step of allowing the first composition to melt. According to an embodiment, after melting of the first composition 51 and/or the second composition 52, the substance 60 has a cross-sectional area less than 0.05 square inches (32.3 square millimeters), preferably less than 0.01 square inches (6.5 square millimeters).

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of removing a wellbore isolation device comprising:

introducing a solid wellbore isolation device comprising one of a ball, a plug, a bridge plug, a wiper plug, and a packer into a wellbore, wherein the same solid wellbore isolation device while maintaining its solidity creates a seal that seals a zone preventing fluid communication into zones downstream of the solid wellbore isolation device;

increasing the temperature surrounding the wellbore isolation device, wherein the step of increasing comprises injecting a fluid from the earth's surface into a bottomhole portion of a wellbore, wherein the step of increasing the temperature includes introducing a heated fluid from the earth's surface, and wherein the wellbore isolation device comprises:

a first composition, wherein the first composition comprises:

(A) a first substance comprising a metal or metal alloy; and (B) a second substance comprising a metal or metal alloy, wherein the first composition has a solid-liquid phase transformation temperature less than the solid-liquid phase transformation temperatures of at least the first substance or the second substance at a specific pressure; and allowing at least a portion of the first composition to undergo a phase transformation from a solid to a liquid due to the increasing of the temperature surrounding the wellbore isolation device.

2. The method according to claim 1, wherein the isolation device is a ball.

3. The method according to claim 1, wherein the first composition is a eutectic composition, a hypo-eutectic composition, or a hyper-eutectic composition.

4. The method according to claim 1, wherein the first composition is a solid at a temperature of 71° F. (21.7° C.) and a pressure of 101 kilopascals.

5. The method according to claim 1, wherein the first substance and the second substance are an element or a compound.

6. The method according to claim 5, wherein the first substance or the second substance comprises (i) the metal and a plastic, (ii) the metal alloy and a plastic, or (iii) the metal, the metal alloy and a plastic.

7. The method according to claim 6, wherein the metal or metal alloy can be selected from the group consisting of beryllium, tin, iron, nickel, copper, zinc, and combinations thereof.

8. The method according to claim 1, wherein the isolation device further comprises a second composition, wherein the second composition comprises two or more substances and wherein the second composition has a solid-liquid phase transformation temperature less than the solid-liquid phase transformation temperatures of at least one of the two or more substances at a specific pressure.

9. The method according to claim 8, wherein the solid-liquid phase transformation temperature of the second composition is different from the solid-liquid phase transformation temperature of the first composition.

10. The method according to claim 8, wherein the second composition is a eutectic composition, a hypo-eutectic composition, or a hyper-eutectic composition.

11. The method according to claim 10, wherein at least one of the two or more substances making up the second composition is different from the first substance and the second substance.

12. The method according to claim 1, wherein the isolation device comprises an outer layer of the first composition.

13. The method according to claim 1, wherein at least the first composition is capable of withstanding a specific pressure differential.

14. The method according to claim 13, wherein the pressure differential is in the range from about 100 to about 25,000 pounds force per square inch (about 0.7 to about 172.4 megapascals).

15. The method according to claim 1, wherein at least the first composition comprises one or more tracers.

16. The method according to claim 1, further comprising the step of positioning the isolation device into a portion of the wellbore, wherein the step of positioning is performed prior to the step of causing or allowing an increase in the temperature surrounding the wellbore isolation device.

17. The method according to claim 1, further comprising the step of removing all or a portion of the liquid first composition, wherein the step of removing is performed after the step of allowing at least a portion of the first composition to undergo a phase transformation from a solid to a liquid.

18. The method according to claim 1, wherein the step of allowing allows at least a portion of the first composition to undergo a phase transformation from a solid to a liquid to flow the isolation device from the wellbore without use of a retrieval apparatus to remove the isolation device.

19. The method according to claim 1, wherein in the step of increasing the temperature, the injected fluid has a temperature greater than or equal to the solid-liquid phase transformation temperature of at least the first composition and the second composition.

20. A solid wellbore isolation device for introduction into a wellbore comprising:

a first composition, wherein the first composition comprises:

(A) a first substance; and (B) a second substance, wherein the first composition has a solid-liquid phase transformation temperature less than the solid-liquid phase transformation temperatures of at least the first substance or the second substance at a specific pressure, wherein the solid isolation device maintains its solidity from introduction into the wellbore to creation of a seal that seals a zone and the solid isolation device is thereafter meltable by increasing the temperature surrounding the solid wellbore isolation device by injecting a fluid from the earth's surface to flow the isolation device from the wellbore without use of a retrieval apparatus to remove the isolation device, wherein the solid wellbore isolation device introduced into the wellbore comprises one of a ball, a plug, a bridge plug, a wiper plug, and a packer and is capable of sealing a zone preventing fluid communication into zones downstream of the solid wellbore isolation device without undergoing a solid-liquid phase transformation, wherein the first substance comprises a first metal or metal alloy, and the second substance comprises a metal or metal alloy and the first composition melts at a desired range of temperatures using a gas introduced from the earth's surface.

21. The solid wellbore isolation device according to claim 20, wherein the first substance or the second substance comprises a metal or a metal alloy and is removable by undergoing a phase transformation from a solid to a liquid and remains a liquid during removal of the isolation device.

22. A method of inhibiting or preventing fluid flow in a wellbore comprising:

decreasing the temperature of at least a portion of the wellbore;

positioning a solid wellbore isolation device comprising one of a ball, a plug, a bridge plug, a wiper plug, and a packer in the at least a portion of the wellbore maintaining solidity of the solid wellbore from introduction into the wellbore until the solid wellbore isolation device creates a seal that seals a zone, wherein the step of positioning is performed during and/or after the step of decreasing, and wherein the solid wellbore isolation device comprises a first composition, wherein the first composition comprises:

(A) a first substance; and (B) a second substance, wherein the first composition has a solid-liquid phase transformation temperature less than the solid-liquid phase transformation temperatures of at least the first substance or the second substance at a specific pressure; and increasing the temperature of the at least a portion of the wellbore by injecting a fluid from the earth's surface, wherein the fluid is a gas, wherein the fluid has a temperature greater than or equal to the solid-phase transformation temperature of at least the first composition, wherein the step of increasing is performed after the step of positioning the solid wellbore isolation device, and wherein at least a portion of the first composition undergoes a phase transformation from a solid to a liquid during or after the step of increasing the temperature to flow the isolation device from the wellbore without use of a retrieval apparatus to remove the isolation device.

23. The method according to claim 22, wherein the first substance or the second substance comprises a metal or a metal alloy and is removable by undergoing a phase transformation from a solid to a liquid and remains a liquid during removal of the isolation device.

* * * * *